US005111628A

United States Patent [19]

Desjoyaux et al.

[11] Patent Number: 5,111,628

[45] Date of Patent: May 12, 1992

[54] PANEL TO PRODUCE SWIMMING POOLS PARTICULARLY AND ITS PRODUCTION PROCESS

[76] Inventors: J. L. Desjoyaux; P. L. Desjoyaux; C. Desjoyaux Epouse Jandros, all of R. N. 82, 42480 La Fouillouse, France

[21] Appl. No.: 456,735

[22] Filed: Dec. 26, 1989

[30] Foreign Application Priority Data

Jan. 9, 1989 [FR] France ..... 89 00722

[51] Int. Cl.[5] ..... E02D 27/00

[52] U.S. Cl. ..... 52/169.7; 249/13; 249/33; 249/35

[58] Field of Search ..... 52/169.6, 169.7, 169.8, 52/259, 293; 249/DIG. 3, 13, 33, 35, 40, 44, 47

[56] References Cited

U.S. PATENT DOCUMENTS 2,200,636 5/1940 Palmer ..... 52/293
4,206,267 6/1980 Jungbluth ..... 52/309.14

FOREIGN PATENT DOCUMENTS 1162919 4/1958 France ..... 52/259
2566447 12/1985 France ..... 52/169.7

*Primary Examiner*—James L. Ridgill, Jr.
*Attorney, Agent, or Firm*—Eric P. Schellin

[57] ABSTRACT

A panel for the construction of swimming pools consisting of a prefabricated structure of reinforced resin concrete, at least one separate reinforcement element 2 corresponding to the height of the panels, the separate reinforcement element 2 comprising a transversal section suitable for defining a vertical gutter formed between two support wings located in one and the same plane, which wings are designed so as to assure the fixation of the element 2 on one of the faces of the structure, the separate reinforcement element 2 comprising a squared edge **2*d* in its upper part, the vertical gutter of the separate reinforcement element 2 communicates with the squared edge 2*d*, and the vertical gutter 2*a* receives concrete over the totality of its height in communication with a series of clamps located in the squared edge 2*d*** of the separate reinforcement element.

9 Claims, 5 Drawing Sheets

Fig. 3
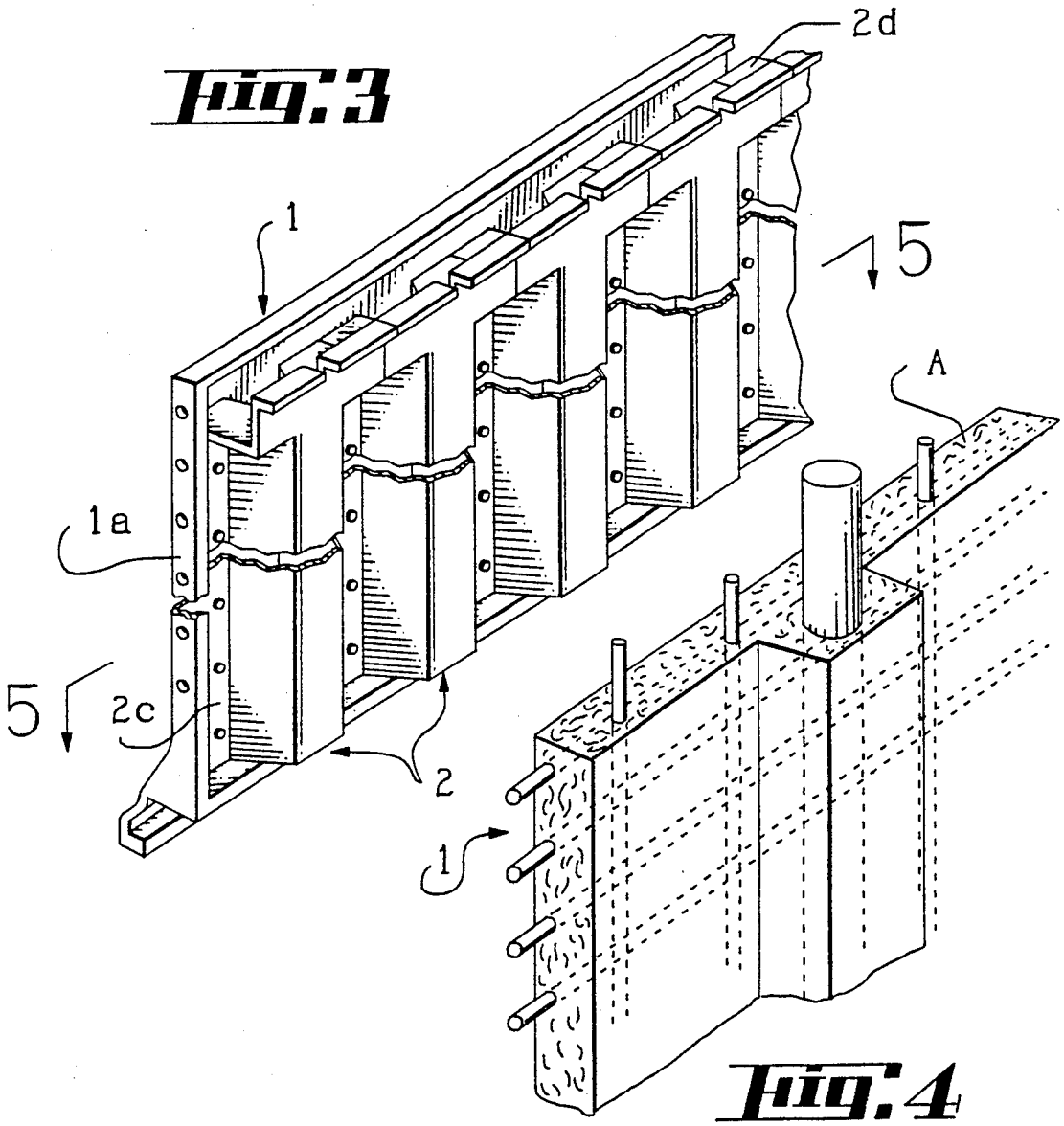
Fig. 4
Fig. 5
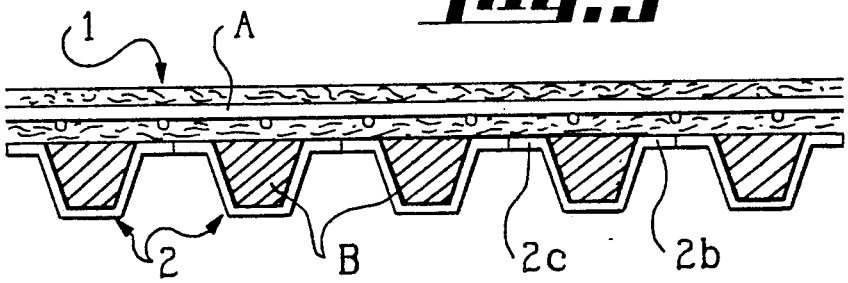

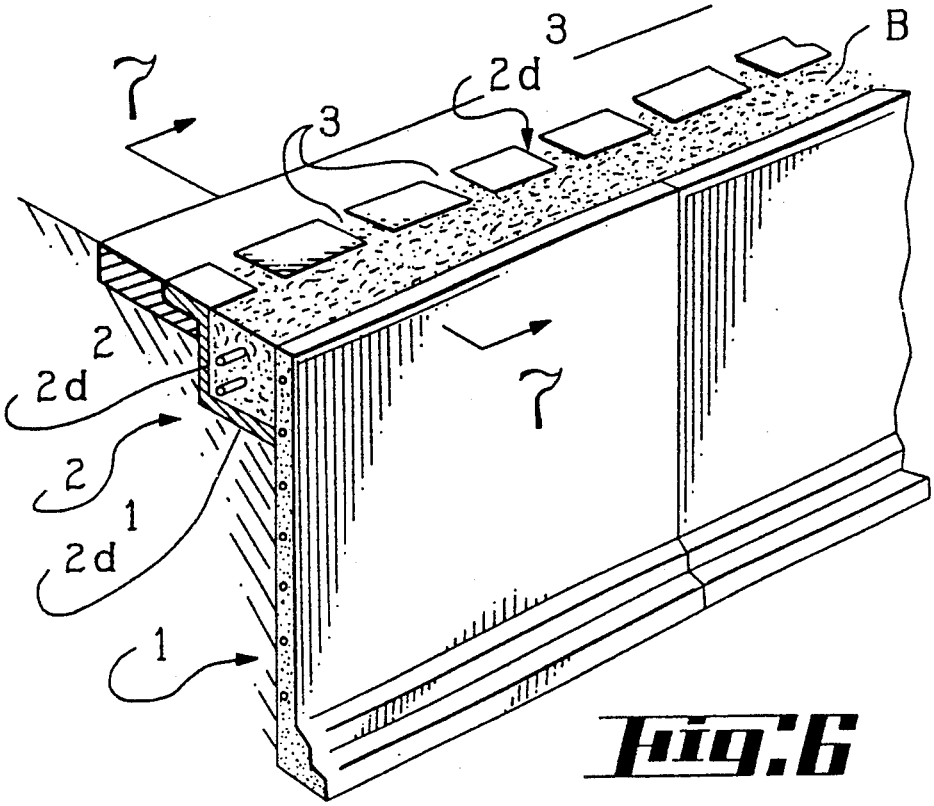
Fig. 6
Fig. 7
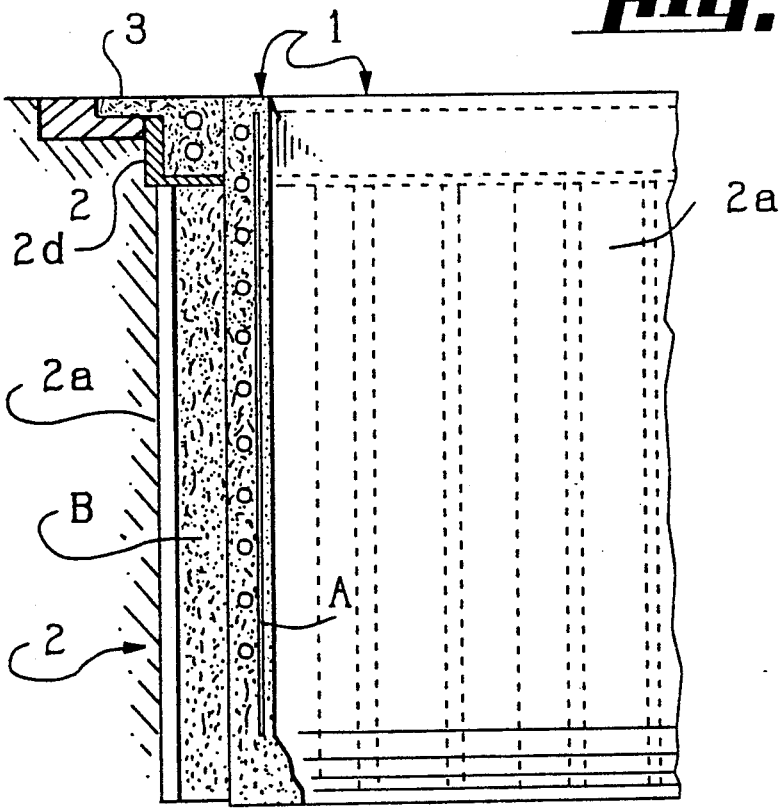

PANEL TO PRODUCE SWIMMING POOLS PARTICULARLY AND ITS PRODUCTION PROCESS

BACKGROUND OF THE INVENTION

1. Field of the Invention

The invention relates to the technical sector of construction elements.

In general, two large manufacturing methods can be distinguished. According to a first manufacturing method, a tradtional procedure is carried out by pouring concrete into formworks in order to produce the walls of the swimming pool. Once the concrete has set, the formworks are removed. This procedure is relatively heavy and expensive. After form removal, it is then necessary to line the inside of the swimming pool by means of tiles for example.

In another manufacturing method, prefabricated polyester panels are used. This construction is easy, however, it is relatively expensive. Problems relating to strength may also arise.

2. Description of the Prior Art

In order to overcome these disadvantages, panels which are used as disposable formworks have been offered. For example, the French patent 81.24031 whose applicants are also the holders, can be mentioned. However, by way of their design, this type of panel cannot be made on an industrial scale, therefore, once again, relatively high manufacturing costs are involved. Problems regarding storage and transport of the panels may also arise.

SUMMARY OF THE INVENTION

The invention is aimed at overcoming these disadvantages in a simple and efficient manner.

In order to overcome the problem brought up, i.e. of having a panel likely to be made on an industrial scale whilst being very stiff, all of the said panels destined to produce the swimming pool, are made up of a prefabricated structure made of resin reinforced concrete, one of the sides of the panel taking, throughout its height, at least one reinforcing component, designed to be built up and fixed onto the corresponding side of the structure, thereby being formed with a section in order to take concrete over its entire height, communicating with a wall tie which has an L-section edge (*2d*) formed at the top part of the said component.

The problem brought up i.e. to make up a panel formed to be used as disposable formwork, is overcome in that the component has a cross section likely to define a vertical gutter between two supporting and fixing legs situated in the same plane, the said gutter communicating with the L-section edge.

From this basic design, the panel can have one single reinforcing component acting as formwork and a wall tie, in order to make up a narrow panel, or several reinforcing components acting as formwork and a wall tie, the said components being arranged side by side.

The vertical sides of the panels have assembling means particularly in the form of vertical legs designed to take (in pairs), complementary fixing components provided for the panels to be assembled to one another.

In an advantageous manner, particularly in the case of a narrow panel, with one single reinforcing component such as defined, the vertical assembling legs have, (in pairs) complementary fixing components of the tongue and groove type, likely to be deformed under a physical effect to provide the coupling. Once these narrow panels have been executed, they make up sub-assemblies likely to be stored and transported separately, non-assembled, then assembled where the swimming pool is to be executed in order to make bigger panels.

According to another characteristic of the invention, the vertical part of the L-section edge of the or each of the reinforcing components has a notch in order for a bar with connection to the lip to pass through and rest upon.

Another characteristic lies in the fact that one of the vertical edges of the reinforcing component, has, at its corresponding support leg and throughout its height, a covering and positioning leg likely to cooperate with the corresponding leg of an adjacent component.

Another problem the invention intends to solve, is to be able to easily discharge the air and water when pouring the concrete into the reinforcing component(s). With this in mind, the side of the structure taking the reinforcing component(s) in a built up manner, has vertical and horizontal stiffening ribs in order to create a space acting as a compression chamber after the reinforcing component(s) have been applied at their support legs in particular.

BRIEF DESCRIPTION OF THE DRAWINGS

The invention is now described in more detail with the help of the following accompanying drawings in which:

FIG. 3 is a perspective view of another embodiment of a panel according to the invention in which the reinforcing components are assembled side by side.

FIG. 4 is a perspective view with partial section of a simplified embodiment of a panel. The thickness of the structure was purposely exaggerated for a better understanding.

FIG. 5 is a section taken along line 5—5 of FIG. 3.

FIG. 6 is a perspective view showing the assembly of the different panels according to the invention with wall tie poured.

FIG. 7 is a cross section taken along line 7—7 of FIG. 6.

The object of the invention will become apparent when described in a non-limitative manner when considered in conjunction with the examples of embodiment of the figures of drawings.

DETAILED DESCRIPTION OF A PREFERRED EMBODIMENT

The panel according to the invention is made up of a prefabricated structure (1) made of resin reinforced concrete. One of the sides of the structure (1) has, throughout its height, at least one vertical reinforcing component described as (E). In order for this structure to be executed, a reinforcement (A) is arranged at the bottom of a mould and the resin concrete is injected. As FIGS. 4 and 5 show in particular, the reinforcement (A) is embedded into the thickness of the resin concrete structure (1).

The reinforcement (A) can be made, in the known manner, by interlacing vertical and horizontal bars. In another form of embodiment, the reinforcement can be made by means of a cardboard, corrugated cardboard in particular or suchlike material.

Similarly, the structure thus executed, can have vertical legs (1*a*) and (1*b*) at each of its lateral ends during its injection, the said legs being likely to provide the assembly of the adjacent analogue panels in combination with suitable fixing components, such as screw, nuts. A silicone seal or another sealing component can be inserted, in the known manner, between each of the legs of the two adjacent panels. In addition, in a known manner, the structure (1) obtained is of a general quadrangular shape whilst being flat or slightly convex. Similarly, some structures can be designed directly or in a built up manner, in order to make up corner panels.

In an advantageous manner, the thickness of the structure (1) increases towards its bottom end in order to make up, particularly in combination with the reinforcing components, a panel which acts as formwork with variable inertia as the thrust takes place at the bottom part of the panels (FIGS. 6 and 7).

According to an important characteristic at the basis of the invention, the vertical reinforcing component (E) is formed with a section to take the concrete over its entire height and has an L-section edge in its top part which is likely to take a wall tie (C). In addition, the component (E) is designed to be built up and fixed by any known means onto one of the sides of the structure (1).

Figure 1:
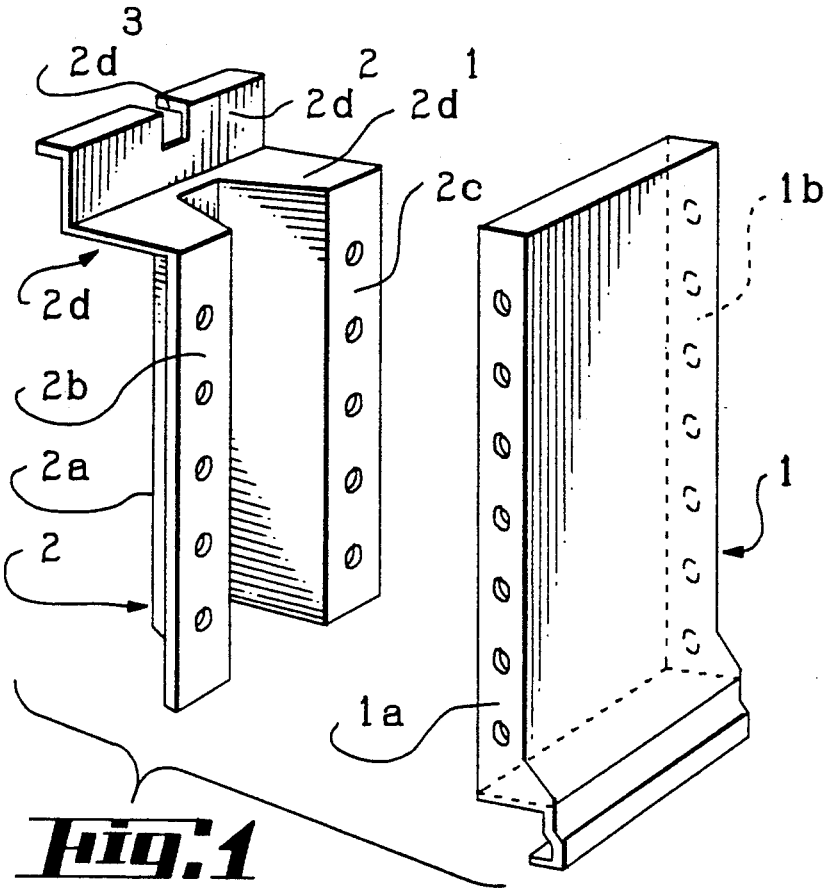
FIG. 1 is a perspective view of a first embodiment of a panel, the components of which have been shown before assembly.

With this in mind, as shown in the figures of the drawings, the vertical reinforcing component is made up of a column (2) with a trapezoidal cross section in order to define a vertical gutter (2*a*) between two support legs (2*b*) and (2*c*) situated in the same plane. The gutter (2*a*) thus defined, is in communication with an L-section edge (2*d*) particularly with the horizontal leg (2*d*1) of the said L-section edge (FIG. 1).

The reinforcing component (2) is fixed in a built up manner by means of legs (2*a*) and (2*b*) which are applied to the corresponding side of the structure whilst being integral to it by any suitable known means, such as bonding. The legs (2*a*) and (2*b*) have any embodiment required to enable the whole the component (2) to be fixed in a safe and efficient way.

Figure 12:
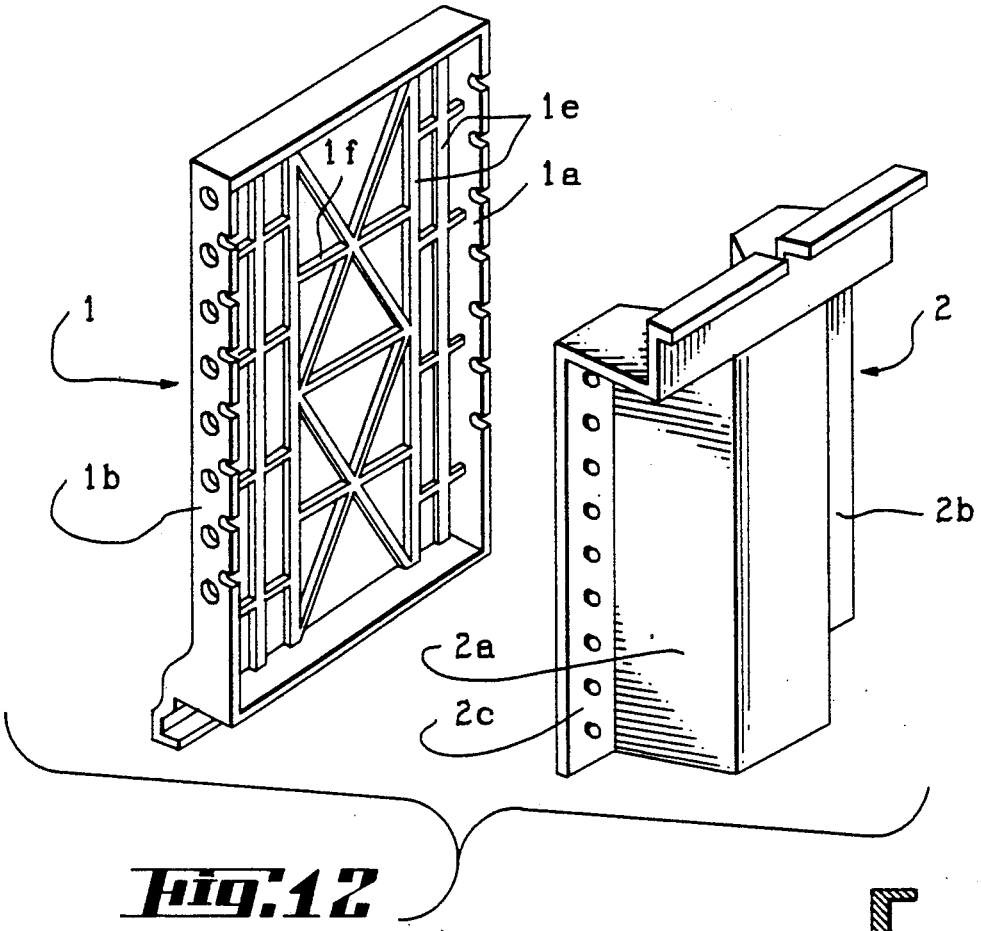
FIG. 12 is a perspective view of the structure before fixing the reinforcing component.
Figure 13:
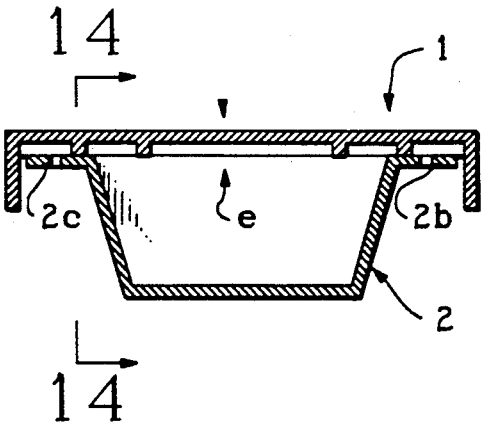
FIG. 13 is a cross section corresponding to FIG. 12 after fixing the reinforcing component onto the corresponding side of the structure.
Figure 14:
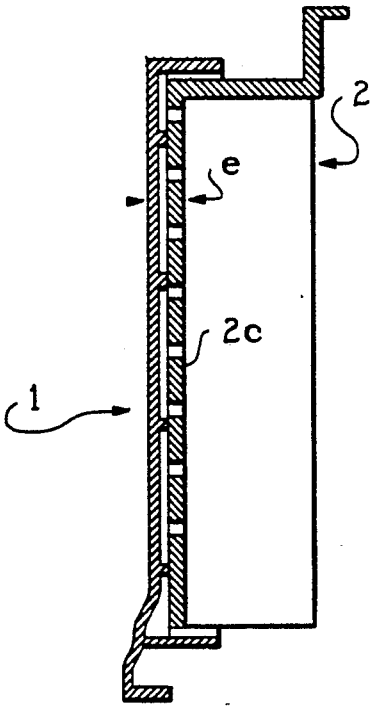
FIG. 14 is a section taken along line 14—14 of FIG. 13.

According to another characteristic, as FIGS. 12, 13 and 14, in particular, the side of the structure taking the reinforcing component(s) in a built up manner, has vertical and horizontal stiffening ribs (1*e*) and (1*f*) (FIG. 12) directly at the time of its fixing. It turns out that after applying the component(s) (2) onto the structure, the fixing legs (2*b*) and (2*c*) are applied against all the said ribs which spaces out the said legs of the corresponding side of the structure. The space (e) (FIGS. 13 and 14) acts as a decompression chamber and enables the air and excess water of the concrete poured into the vertical gutter or reinforcing components and in the top wall tie particularly at the legs, to be discharged. This gives rise to better settling of the concrete, whilst reducing the pressure applied to the structure by the said concrete.

Figure 2:
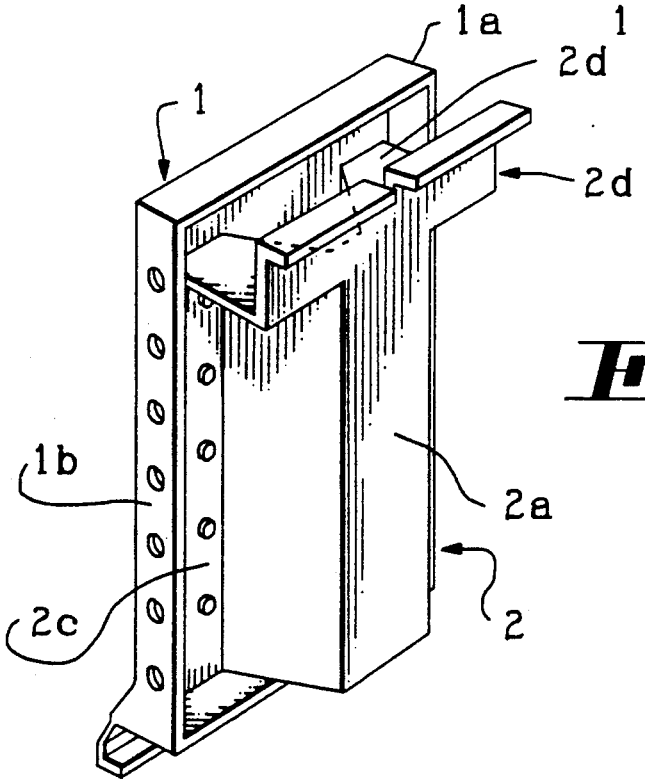
FIG. 2 is a perspective view corresponding to FIG. 1 after assembling the component parts.

From this basic design, the panel can have one single reinforcing component (2) acting as formwork and a wall tie (FIGS. 1, 2 and 10) or several reinforcing components (2) acting as formwork and wall ties arranged side by side (FIGS. 3, 5, 6, 7, 11).

Figure 8:
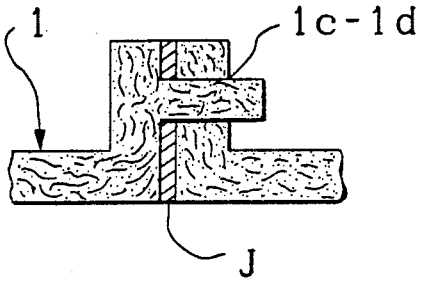
FIG. 8 is a purely schematic partial view showing a method to assemble the panels to one another, particularly in the case of narrow panels.
Figure 9:
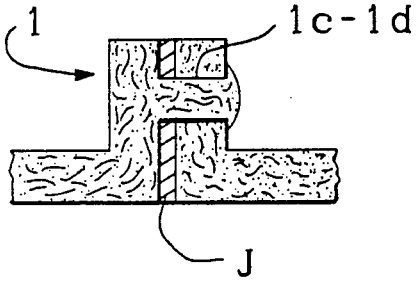
FIG. 9 is a view corresponding to FIG. 8 after deformation of the assembly components in order to enable the panels to be coupled.

In an advantageous manner, particularly in the case of a narrow panel (FIG. 2), i.e. a structure (1) comprising, one single component (2) between each of the vertical assembly legs (1*a*) and (1*b*), the said legs having (in pairs) complementary fixing components of the tongue and groove type (1*c*–1*d*). These fixing components (1*c*–1*d*) are likely to be deformed under a physical effect such as electro-welding in order for the panels thus executed, to be coupled (FIGS. 8 and 9).

Figure 10:
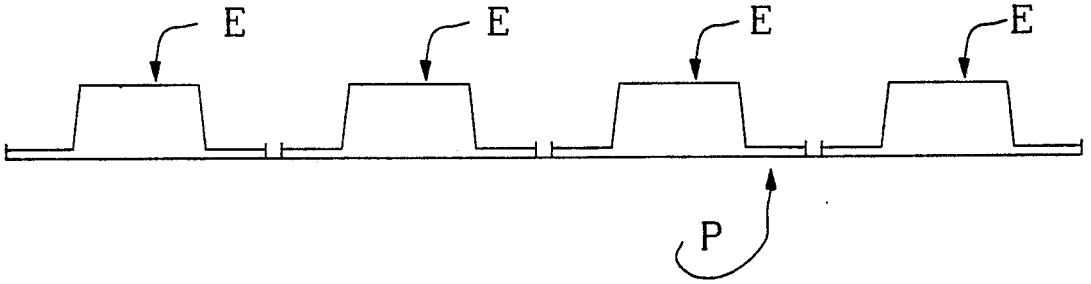
FIG. 10 is a schematic section showing the assembly of different sub-assemblies as illustrated in FIG. 2 for the execution of a standard width panel.

Therefore, it appears that these narrow panels, make up sub-assemblies (E) likely to be stored and transported separately, non-assembled, therefore there is a very great deal of space saved. They then have to be assembled on the site where the swimming pool is to be executed, in the conditions indicated, in order to make up the panel (P) as such (FIG. 10).

Figure 11:
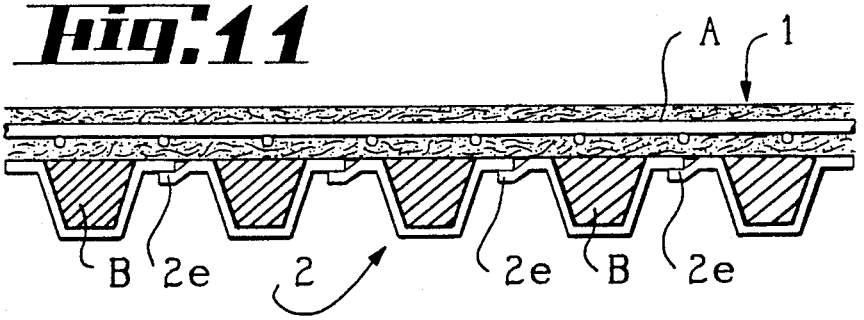
FIG. 11 is a longitudinal section of another form of embodiment corresponding to FIG. 5.

In the event of each of the panels (P) being made up of a structure (1) with several vertical components (2) side by side, one of the support legs (2*b*) or (2*c*) of the said component can have a covering leg (2*e*) along its entire height, likely to cooperate with the corresponding leg of an adjacent component (2) (FIG. 11).

After assembling the different panels executed according to the characteristics of the invention and correctly arranged in order to make up a swimming pool of the desired shapes and dimensions, the concrete (B) is poured firstly, into each of the vertical gutters (2*a*) of the reinforcing components (2) and secondly, into the continuous wall tie made up by the alignment of the different L-section edges (2*d*) (FIGS. 6 and 7). In an advantageous manner, the concrete (B) is reinforced.

The panels (P) thus executed are of the self-supporting type by making up a disposable formwork whilst being likely to take the filling up earth where the swimming pool is executed directly. In addition, the vertical leg (2*d*2) of each of the L-section edges (2*d*) has a notch (2*d*3) in its median part for a bar (3) for connection with the lip to pass through and rest upon (FIG. 7).

The advantages are made well apparent from the description. The following is highlighted in particular:

The reinforcing components considered separately in combination, make up a wall tie directly when they are being manufactured.

Every one of the panels is of the self-supporting type making up a disposable formwork.

The stiffness of the basic structure of each of the panels resulting from the injection of a concrete resin on a reinforcement priorly arranged at the bottom of a mould so as to make up a panel made of reinforced concrete resin.

The industrial production of a panel, each of the components parts, i.e. the basic structure (1) and the built up reinforcing component(s) (2) being likely to be made by injection.

The easy transport and storage of the panels, considering the structure as such is independent from the reinforcing components.

We claim:

1. A panel for the construction of swimming pools having a dimension of height comprising a prefabricated structure 1 of reinforced resin concrete, at least one separate reinforcement element 2 corresponding to the height of the panel, the separate reinforcement element 2 comprising a transversal section suitable for defining a vertical gutter 2*a* formed between two support wings 2*a*–2*b* . . . located in one and the same plane, which wings are constructed and arranged so as to assure the fixation of the element 2 on one of the faces of the structure, the separate reinforcement element 2 comprising a squared edge 2*d* in its upper part, the vertical gutter 2*a* of the separate reinforcement element 2 communicating with the squared edge 2*d*, and the vertical gutter 2*a* receiving concrete over totality of its height in communication with a series of clamps located in the squared edge 2*d* of the separate reinforcement element.

2. The panel according to claim 1, in which the transversal section to the vertical gutter is configured in a trapezoidal shape.

3. The panel according to claim 1, comprising a single one only of the separate vertical reinforcement element 2 located between projecting vertical wings 1*a*–1*b* at each of the lateral ends of the structure and conformed so as to assure assemblage of the panel with analogous adjacent panels.

4. The panel according to claim 1, in which the vertical part of the squared edge 2*d* of the reinforcement element or of each of the reinforcement elements 2 comprises a notch $2d^3$ for the passage and the support of an iron means for connection to border means.

5. The panel according to claim 1, in which one of the vertical edges of the reinforcement element comprises a covering and positioning rabbet 2*e* at the level of its corresponding support wing and over the totality of its height, which rabbet cooperates with the corresponding wing of an adjacent element.

6. The panel according to claim 1, in which the structure 1 exhibits a thickness which increases progressively in the direction of its lower end.

7. The panel according to claim 1, in which the face of the structure 1 which receives the reinforcement element or elements 2 in a separate manner comprise vertical and horizontal bracing ribs 1*e*, 1*f* in such a manner as to create a space e which functions as a decompression chamber after the application of the reinforcement element or elements, especially at a level of their support wings.

8. The panel according to claim 1, comprising several vertical reinforcement elements 2 located in juxtaposition and between projecting vertical wings 2*a*–2*b* at each of the lateral ends of the structure and conformed so as to assure assemblage of the panel with analogous adjacent panels.

9. The panel according to any one of the claim 8, in which the assemblage of the vertical wings 1*a*–1*b* both comprise complementary fixation members of the mortized tenon type 1*c*–1*d* which is deformable under a physical effect in order to assure coupling of the several panels.

* * * * *